US011029060B2

(12) United States Patent
Kawanori et al.

(10) Patent No.: US 11,029,060 B2
(45) Date of Patent: Jun. 8, 2021

(54) AIR-CONDITIONING APPARATUS

(71) Applicant: Mitsubishi Electric Corporation, Tokyo (JP)

(72) Inventors: Yukihiko Kawanori, Tokyo (JP); Keiichi Yamamoto, Tokyo (JP); Hiroshi Tsutsumi, Tokyo (JP); Ayaka Ueyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 539 days.

(21) Appl. No.: 15/322,548

(22) PCT Filed: Sep. 18, 2014

(86) PCT No.: PCT/JP2014/074723
§ 371 (c)(1),
(2) Date: Dec. 28, 2016

(87) PCT Pub. No.: WO2016/042643
PCT Pub. Date: Mar. 24, 2016

(65) Prior Publication Data

US 2017/0159967 A1 Jun. 8, 2017

(51) Int. Cl.
*F24F 13/30* (2006.01)
*F24F 1/16* (2011.01)
(Continued)

(52) U.S. Cl.
CPC ..... *F24F 13/30* (2013.01); *F24F 1/16* (2013.01); *F24F 1/46* (2013.01); *F24F 1/48* (2013.01);
(Continued)

(58) Field of Classification Search
CPC ..... F24F 13/30; F24F 13/222; F24F 13/22; F24F 1/48; F24F 1/46; F24F 1/16; F25D 21/14
See application file for complete search history.

(56) References Cited

U.S. PATENT DOCUMENTS 3,831,670 A * 8/1974 Mullings ..... F24F 13/20 165/124
4,000,779 A * 1/1977 Irwin ..... B01D 45/06 165/111
(Continued)

FOREIGN PATENT DOCUMENTS

JP S58-162473 U 10/1983
JP H11-063551 A 3/1999

OTHER PUBLICATIONS

Office Action dated Dec. 15, 2017 issued in corresponding CA patent application No. 2,954,337.
(Continued)

*Primary Examiner* — Edward F Landrum
*Assistant Examiner* — Melodee M Jefferson
(74) *Attorney, Agent, or Firm* — Posz Law Group, PLC

(57) ABSTRACT

An air-conditioning apparatus includes a heat-exchange unit. The heat-exchange unit has a pair of heat exchangers, and a partition plate disposed in such a state that a first region located on the inside of a space between the pair of heat exchangers and a second region located on the outside of the space are formed. The heat-exchange unit is disposed in such an orientation that one of the pair of heat exchangers is provided adjacent to and above the other heat exchanger and that the second region of the partition plate is located on the downstream side of the first region. The second region of the partition plate is provided with an inlet of a drain path.

8 Claims, 6 Drawing Sheets

(51) Int. Cl.

| | |
|---|---|
| ***F24F 13/22*** | (2006.01) |
| ***F24F 1/48*** | (2011.01) |
| ***F25D 21/14*** | (2006.01) |
| ***F24F 1/46*** | (2011.01) |

(52) U.S. Cl.
CPC ..... *F24F 13/22* (2013.01); *F24F 13/222* (2013.01); *F25D 21/14* (2013.01)

(56) References Cited

U.S. PATENT DOCUMENTS

| | | | | |
|---|---|---|---|---|
| 5,979,171 | A | 11/1999 | Mitchell et al. | |
| 2007/0169499 | A1* | 7/2007 | Rios | F24F 13/222 62/285 |
| 2007/0169500 | A1* | 7/2007 | Rios | F24F 13/222 62/285 |
| 2012/0031134 | A1* | 2/2012 | Shirota | F24F 1/0029 62/288 |
| 2012/0276836 | A1* | 11/2012 | Stewart | F24F 13/20 454/251 |

OTHER PUBLICATIONS

International Search Report of the International Searching Authority dated Dec. 22, 2014 for the corresponding International application No. PCT/JP2014/074723 (and English translation).

* cited by examiner

AIR-CONDITIONING APPARATUS

CROSS REFERENCE TO RELATED APPLICATION

This application is a U.S. national stage application of PCT/JP2014/074723 filed on Sep. 18, 2014, the contents of which are incorporated herein by reference.

TECHNICAL FIELD

The present invention relates to air-conditioning apparatuses.

BACKGROUND ART

There is a conventional air-conditioning apparatus that includes, for example, a main body having an air passage formed therein, and a pair of heat exchangers provided adjacent to each other in a V-shape in the air passage. By arranging the pair of heat exchangers adjacent to each other in a V-shape, the main body can be made compact. The main body is disposed in such an orientation that an air flow generated in the air passage passes horizontally through the pair of heat exchangers. Furthermore, the pair of heat exchangers are provided adjacent to each other, symmetrically with respect to the horizontal plane. A drain pan is disposed below the pair of heat exchangers (for example, see Patent Literature 1).

CITATION LIST

Patent Literature

Patent Literature 1: The Description of U.S. Pat. No. 4,000,779 (column 2, line 36 to column 5, line 37, and FIGS. 1 to 4)

SUMMARY OF INVENTION

Technical Problem

In such an air-conditioning apparatus, both of the condensate water generated in the heat exchanger located on the upper side and the condensate water generated in the heat exchanger located on the lower side gather at the lower end portion of the heat exchanger located on the lower side, and a large quantity of condensate water drops on the drain pan from the lower end portion. Hence, there has been a problem in that the condensate water is spattered outside the drain pan, causing water leakage or other problems. Furthermore, in order to prevent condensate water dropping from the lower end portion of the heat exchanger located on the upper side from splashing at the drain pan and being spattered outside the drain pan, a condensate guide is disposed on the downstream side of the lower end portion of the heat exchanger located on the upper side. However, because a drain port in the guide condensate is formed on the upstream side of a condensate-water receiving portion in a direction of the air flow; and the condensate water is required to flow against the air flow, which leads to a problem in that the drainage efficiency of the condensate water dropping on the guide plate is low.

The present invention has been made in view of the above-described problems, and provides an air-conditioning apparatus in which spattering of condensate water to the outside of a drain pan is suppressed and in which the condensate-water drainage efficiency is improved.

Solution to Problem

An air-conditioning apparatus according to an embodiment of the present invention includes: a main body having an air passage formed therein; and a heat-exchange unit disposed in the air passage. The heat-exchange unit includes a first heat exchanger and a second heat exchanger provided adjacent to each other; and a partition plate disposed in such a state that a first region located inside a space between the first heat exchanger and the second heat exchanger and a second region located outside the space are formed. In a first disposition state, the main body is disposed in such an orientation that an air flow generated in the air passage passes through the heat-exchange unit in a direction intersecting the direction of gravity. In the first disposition state, the heat-exchange unit is disposed in such an orientation that the first heat exchanger is provided adjacent to and above the second heat exchanger and that the second region of the partition plate is located on the downstream side of the first region. The second region of the partition plate is provided with an inlet of a drain path communicating with the outside of the main body.

Advantageous Effects of Invention

In the air-conditioning apparatus according to an embodiment of the present invention, because the condensate water generated in the first heat exchanger provided adjacent to and above the second heat exchanger can be discharged to the outside of the main body from the inlet of a drain path formed in the second region of the partition plate, which is located on the outside of the space between the first heat exchanger and the second heat exchanger, it is possible to inhibit a large quantity of condensate water from dropping on a drain pan and being spattered outside a drain pan from the lower end portion of the second heat exchanger. Furthermore, because the condensate water is guided to the inlet of a drain path by using the air flow, the condensate-water drainage efficiency is improved.

DESCRIPTION OF EMBODIMENTS

An air-conditioning apparatus of the present invention will be described below by using drawings.

Note that the configurations and the like described below are merely examples, and the air-conditioning apparatus of the present invention is not limited to one having such configurations and the like. Furthermore, detailed descriptions of the configurations and the like are simplified or omitted, as appropriate. Furthermore, overlapping or similar descriptions are simplified or omitted, as appropriate.

Embodiment 1

An air-conditioning apparatus according to Embodiment 1 will be described.

Overall Configuration of Air-Conditioning Apparatus

First, the overall configuration of an air-conditioning apparatus according to Embodiment 1 will be described.

Disposition State in Which Air-Blowing Direction is Oriented Upward

Figure 1:
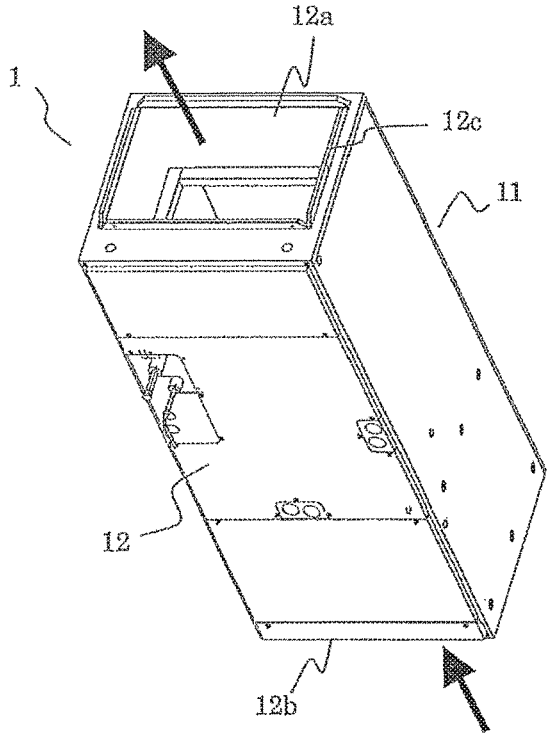
FIG. 1 is a perspective view of an air-conditioning apparatus according to Embodiment 1 of the present invention, in a disposition state in which the air-blowing direction is oriented upward.
Figure 2:
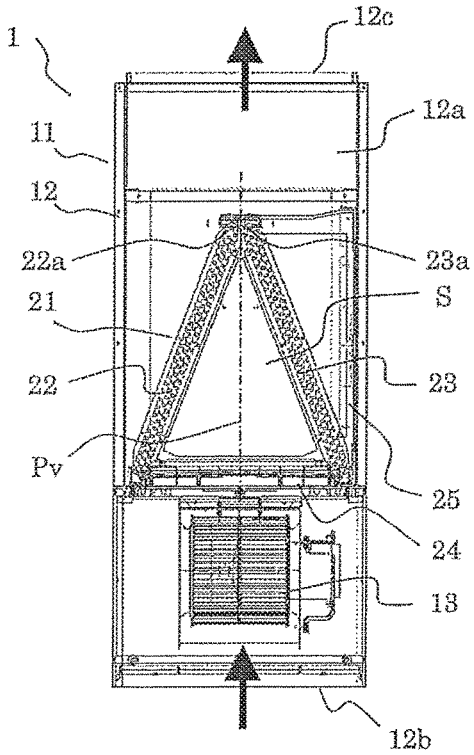
FIG. 2 is a sectional view of the air-conditioning apparatus according to Embodiment 1 of the present invention, in a disposition state in which the air-blowing direction is oriented upward.

FIG. 1 is a perspective view of an air-conditioning apparatus according to Embodiment 1 of the present invention, in a disposition state in which the air-blowing direction is oriented upward. FIG. 2 is a sectional view of the air-conditioning apparatus according to Embodiment 1 of the present invention, in a disposition state in which the air-blowing direction is oriented upward. Note that, in FIGS. 1 and 2, air flows are shown by fill-in arrows. The disposition state in which the air-blowing direction is oriented upward is a normally used disposition state. In other words, when an air-conditioning apparatus 1 is installed, the air-blowing direction can be changed according to the use environment at the installation site.

As shown in FIGS. 1 and 2, the air-conditioning apparatus 1 includes a main body 11 and a heat-exchange unit 21. The main body 11 includes a housing 12 having an air passage 12*a* formed therein, and a fan 13 disposed in the air passage 12*a*, When the fan 13 is driven, an air flow flowing into the air passage 12*a* from an air inlet 12*b* provided at one longitudinal end of the housing 12 and flowing out from an air outlet 12*c* provided at the other longitudinal end of the housing 12 is generated.

The heat-exchange unit 21 is disposed on the downstream side of the fan 13 in the air passage 12*a*. In other words, the main body 11 is disposed in such an orientation that the air flow generated in the air passage 12*a* passes through the heat-exchange unit 21 in the direction opposite to the direction of gravity.

The heat-exchange unit 21 includes a pair of heat exchangers 22 and 23 provided adjacent to each other in a V-shape, a first main drain pan 24, and a second main drain pan 25. The heat-exchange unit 21 is integrally attached to and removed from the main body 11. The configuration of the heat-exchange unit 21 will be described in detail below.

The heat-exchange unit 21 is disposed in such an orientation that an end 22*a* of the heat exchanger 22 closer to the heat exchanger 23 and an end 23*a* of the heat exchanger 23 closer to the heat exchanger 22 are oriented toward the downstream side, that is, upward. Specifically, the heat exchanger 22 and the heat exchanger 23 are provided adjacent to each other, symmetrically with respect to a vertical plane Pv, and a space S between the heat exchanger 22 and the heat exchanger 23 is gradually narrowed toward the upper side. Furthermore, the first main drain pan 24 is located below the heat exchanger 22 and the heat exchanger 23.

The air flow generated in the air passage 12*a* is cooled or heated by passing through the space S between the heat exchanger 22 and the heat exchanger 23 and then passing through the heat exchanger 22 and the heat exchanger 23. The condensate water generated in the heat exchanger 22 and the heat exchanger 23 flows into the first main drain pan 24 and is discharged to the outside of the main body 11 from the first main drain pan 24.

Disposition State in Which Air-Blowing Direction is Oriented Downward

Figure 3:
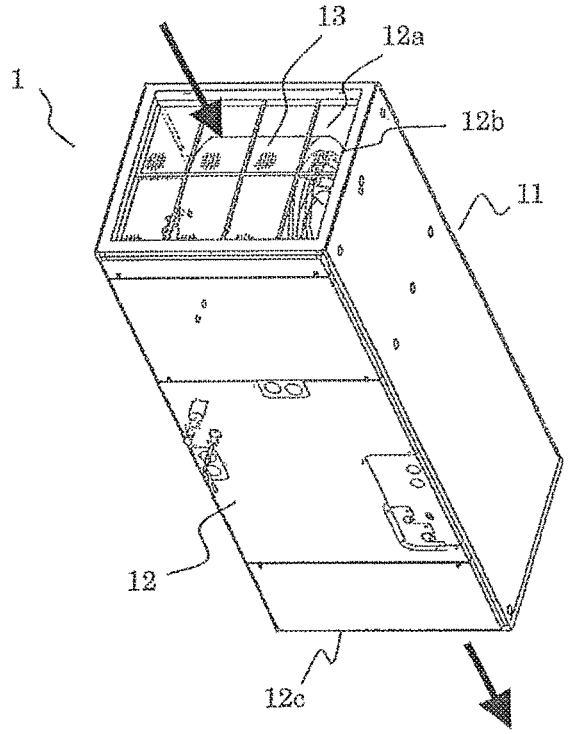
FIG. 3 is a perspective view of the air-conditioning apparatus according to Embodiment 1 of the present invention, in a disposition state in which the air-blowing direction is oriented downward.
Figure 4:
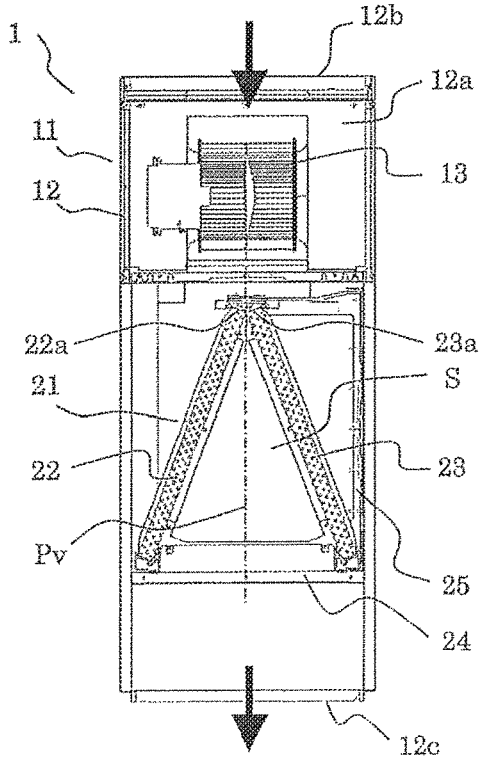
FIG. 4 is a sectional view of the air-conditioning apparatus according to Embodiment 1 of the present invention, in a disposition state in which the air-blowing direction is oriented downward.

FIG. 3 is a perspective view of the air-conditioning apparatus according to Embodiment 1 of the present invention, in a disposition state in which the air-blowing direction is oriented downward. FIG. 4 is a sectional view of the air-conditioning apparatus according to Embodiment 1 of the present invention, in a disposition state in which the air-blowing direction is oriented downward. Note that, in FIGS. 3 and 4, air flows are shown by fill-in arrows.

As shown in FIGS. 3 and 4, the heat-exchange unit 21 is disposed on the downstream side of the fan 13 in the air passage 12*a*. In other words, the main body 11 is disposed in such an orientation that the air flow generated in the air passage 12*a* passes through the heat-exchange unit 21 in the direction of gravity.

The heat-exchange unit 21 is disposed in such an orientation that the end 22*a* of the heat exchanger 22 closer to the heat exchanger 23 and the end 23*a* of the heat exchanger 23 closer to the heat exchanger 22 are oriented toward the upstream side, that is, upward. Specifically, the heat exchanger 22 and the heat exchanger 23 are provided adjacent to each other, symmetrically with respect to the vertical plane Pv, and the space S between the heat exchanger 22 and the heat exchanger 23 is gradually narrowed toward the upper side. Furthermore, the first main drain pan 24 is located below the heat exchanger 22 and the heat exchanger 23.

When the disposition state is changed from a disposition state in which the air-blowing direction is oriented upward to a disposition state in which the air-blowing direction is oriented downward, the heat-exchange unit 21 is removed, the main body 11 turned upside down, and then the heat-exchange unit 21 is disposed in the same orientation as it was in before removal.

The air flow generated in the air passage 12*a* passes through the heat exchanger 22 and the heat exchanger 23 to be cooled or heated and then passes through the space S between the heat exchanger 22 and the heat exchanger 23. The condensate water generated in the heat exchanger 22 and the heat exchanger 23 flows into the first main drain pan 24 and is discharged to the outside of the main body 11 from the first main drain pan 24.

Disposition State in Which Air-Blowing Direction is Oriented Rightward

Figure 5:
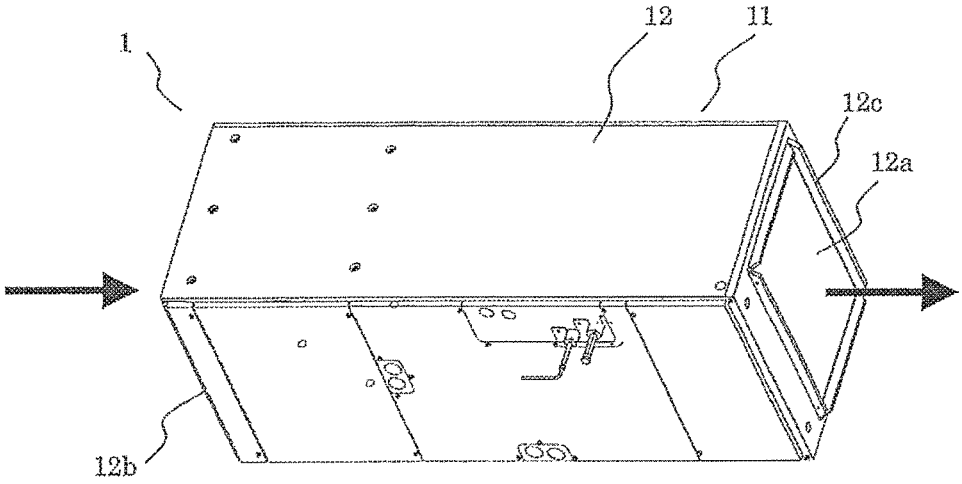
FIG. 5 is a perspective view of the air-conditioning apparatus according to Embodiment 1 of the present invention, in a disposition state in which the air-blowing direction is oriented rightward.
Figure 6:
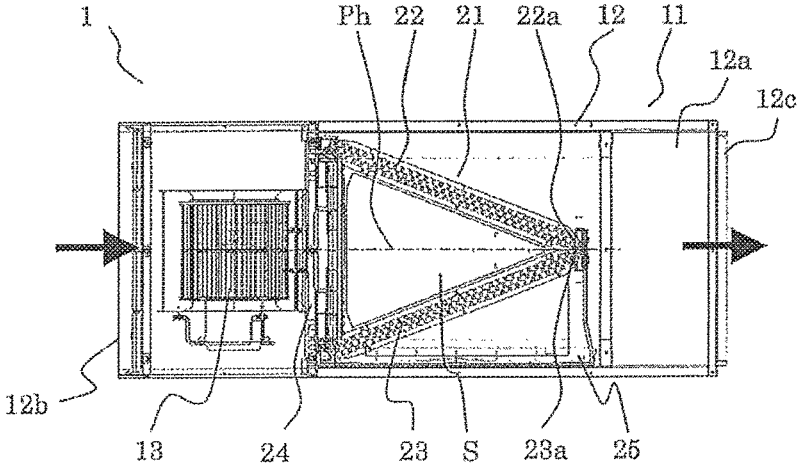
FIG. 6 is a sectional view of the air-conditioning apparatus according to Embodiment 1 of the present invention, in a disposition state in which the air-blowing direction is oriented rightward.

FIG. 5 is a perspective view of the air-conditioning apparatus according to Embodiment 1 of the present invention, in a disposition state in which the air-blowing direction is oriented rightward, FIG. 6 is a sectional view of the air-conditioning apparatus according to Embodiment 1 of the present invention, in a disposition state in which the air-blowing direction is oriented rightward. Note that, in FIGS. 5 and 6, air flows are shown by fill-in arrows. The disposition state in which the air-blowing direction is oriented rightward corresponds to a "first disposition state" of the present invention.

As shown in FIGS. 5 and 6, the heat-exchange unit 21 is disposed on the downstream side of the fan 13 in the air passage 12*a*. In other words, the main body 11 is disposed in such an orientation that the air flow generated in the air passage 12*a* passes horizontally through the heat-exchange unit 21.

The heat-exchange unit 21 is disposed in such an orientation that the heat exchanger 22 is arranged adjacent to and above the heat exchanger 23 and in which the end 22*a* of the heat exchanger 22 closer to the heat exchanger 23 and the end 23*a* of the heat exchanger 23 closer to the heat exchanger 22 are oriented toward the downstream side, that is, rightward, Specifically, the heat exchanger 22 and the heat exchanger 23 are provided adjacent to each other, symmetrically with respect to a horizontal plane Ph, and the space S between the heat exchanger 22 and the heat exchanger 23 is gradually narrowed toward the right side. Furthermore, the second main drain pan 25 is located below the heat exchanger 22 and the heat exchanger 23. The heat exchanger 22 corresponds to a "first heat exchanger" of the present invention, and the heat exchanger 23 corresponds to a "second heat exchanger" of the present invention. The end 22*a* corresponds to a "first end" of the present invention, and the end 23*a* corresponds to a "second end" of the present invention.

When the disposition state is changed from a disposition state in which the air-blowing direction is oriented upward to a disposition state in which the air-blowing direction is oriented rightward, the main body 11 is rotated in the direction in which the right-side surface is located on the lower side, from the state shown in FIGS. 1 and 2.

The air flow generated in the air passage 12*a* passes through the space S between the heat exchanger 22 and the heat exchanger 23 and then passes through the heat exchanger 22 and the heat exchanger 23 to be cooled or heated. The condensate water generated in the heat exchanger 22 and the heat exchanger 23 flows into the second main drain pan 25 and is discharged to the outside of the main body 11 from the second main drain pan 25.

Disposition State in Which Air-Blowing Direction is Oriented Leftward

Figure 7:
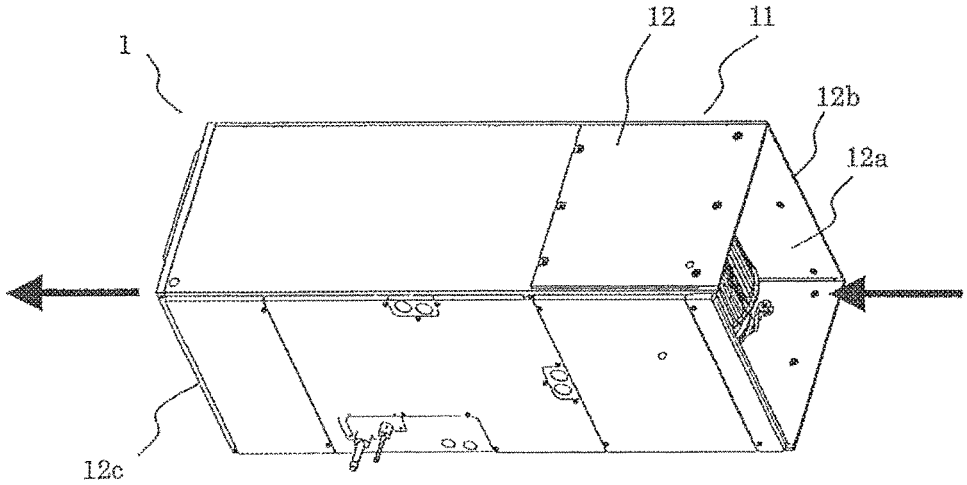
FIG. 7 is a perspective view of the air-conditioning apparatus according to Embodiment 1 of the present invention, in a disposition state in which the air-blowing direction is oriented leftward.
Figure 8:
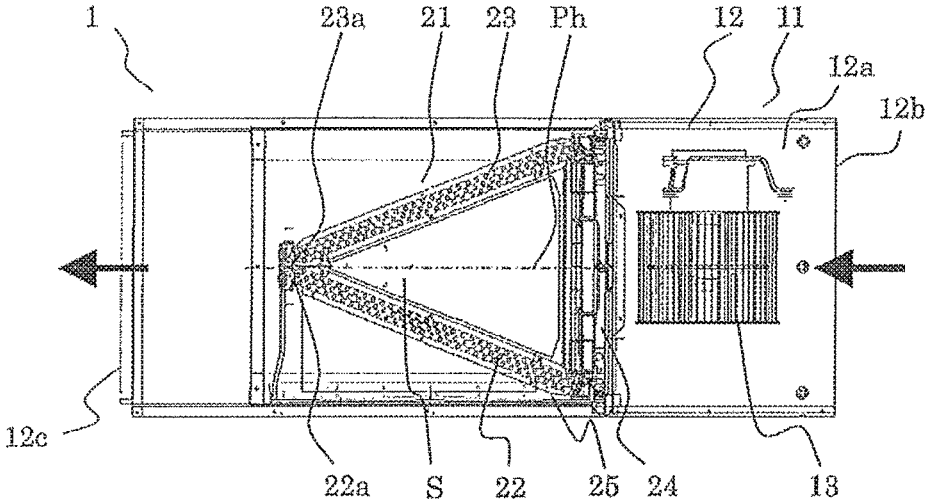
FIG. 8 is a sectional view of the air-conditioning apparatus according to Embodiment 1 of the present invention, in a disposition state in which the air-blowing direction is oriented leftward.

FIG. 7 is a perspective view of the air-conditioning apparatus according to Embodiment 1 of the present invention, in a disposition state in which the air-blowing direction is oriented leftward. FIG. 8 is a sectional view of the air-conditioning apparatus according to Embodiment 1 of the present invention, in a disposition state in which the air-blowing direction is oriented leftward. Note that, in FIGS. 7 and 8, air flows are shown by fill-in arrows. The disposition state in which the air-blowing direction is oriented leftward corresponds to the "first disposition state" of the present invention.

As shown in FIGS. 7 and 8, the heat-exchange unit 21 is disposed on the downstream side of the fan 13 in the air passage 12*a*, In other words, the main body 11 is disposed in such an orientation that the air flow generated in the air passage 12*a* passes horizontally through the heat-exchange unit 21.

The heat-exchange unit 21 is disposed in such an orientation that the heat exchanger 23 is arranged adjacent to and above the heat exchanger 22 and in which the end 22*a* of the heat exchanger 22 closer to the heat exchanger 23 and the end 23*a* of the heat exchanger 23 closer to the heat exchanger 22 are oriented toward the downstream side, that is, leftward, Specifically, the heat exchanger 22 and the heat exchanger 23 are provided adjacent to each other, symmetrically with respect to the horizontal plane Ph, and the space S between the heat exchanger 22 and the heat exchanger 23 is gradually narrowed toward the left side. Furthermore, the second main drain pan 25 is located below the heat exchanger 22 and the heat exchanger 23. The heat exchanger 23 corresponds to the "first heat exchanger" of the present invention, and the heat exchanger 22 corresponds to the "second heat exchanger" of the present invention. The end 23*a* corresponds to the "first end" of the present invention, and the end 22*a* corresponds to the "second end" of the present invention.

When the disposition state is changed from a disposition state in which the air-blowing direction is oriented upward to a disposition state in which the air-blowing direction is oriented leftward, the main body 11 is rotated in the direction in which the left side surface is located on the lower side, from the state shown in FIGS. 1 and 2. Then, the heat-exchange unit 21 is removed, the second main drain pan 25 attached above the heat exchanger 23 is reattached below the heat exchanger 22, and then the heat-exchange unit 21 is disposed in the same orientation as it was in before removal.

The air flow generated in the air passage 12*a* passes through the space S between the heat exchanger 22 and the heat exchanger 23 and then passes through the heat exchanger 22 and the heat exchanger 23 to be cooled or heated. The condensate water generated in the heat exchanger 22 and the heat exchanger 23 flows into the second main drain pan 25 and is discharged to the outside of the main body 11 from the second main drain pan 25.

Configuration of Heat-Exchange Unit

Next, the configuration of the heat-exchange unit of the air-conditioning apparatus according to Embodiment 1 will be described.

Figure 9:
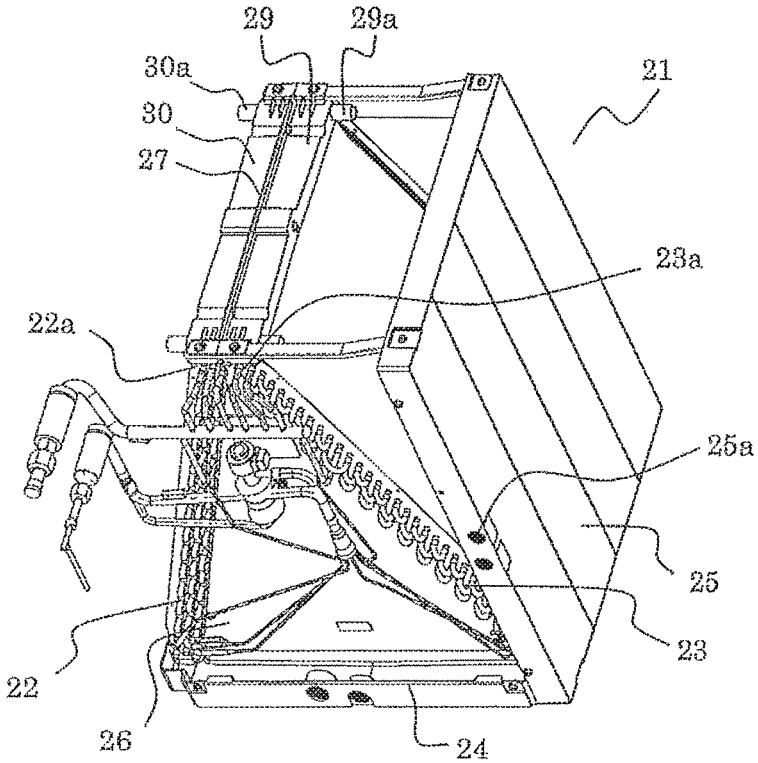
FIG. 9 is a perspective view of a heat-exchange unit of the air-conditioning apparatus according to Embodiment 1 of the present invention.
Figure 10:
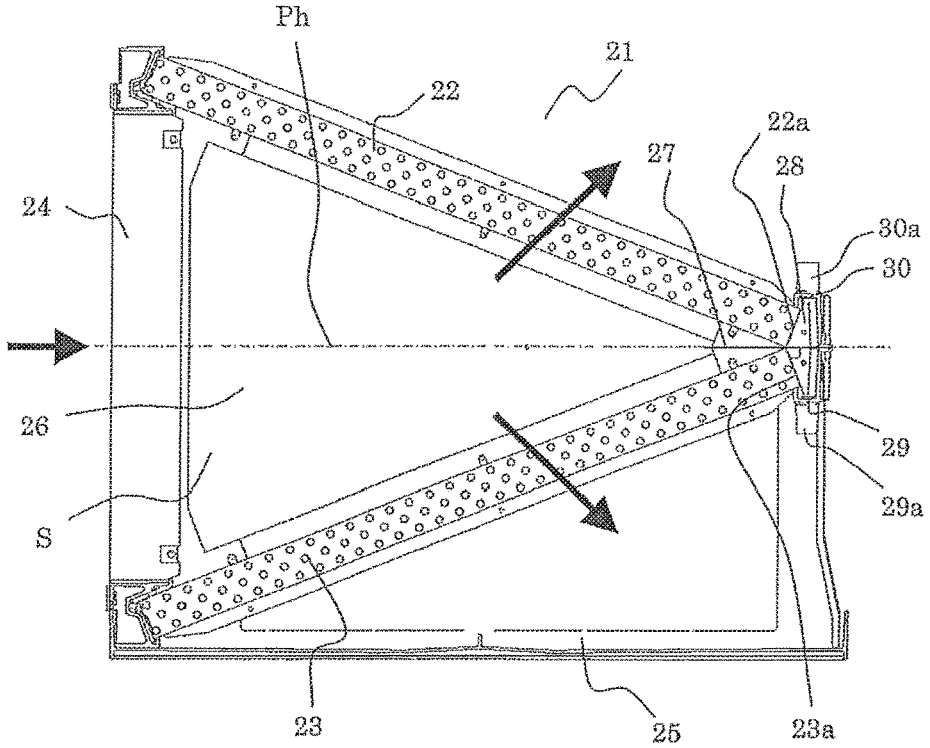
FIG. 10 is a sectional view of the heat-exchange unit of the air-conditioning apparatus according to Embodiment 1 of the present invention.
Figure 11:
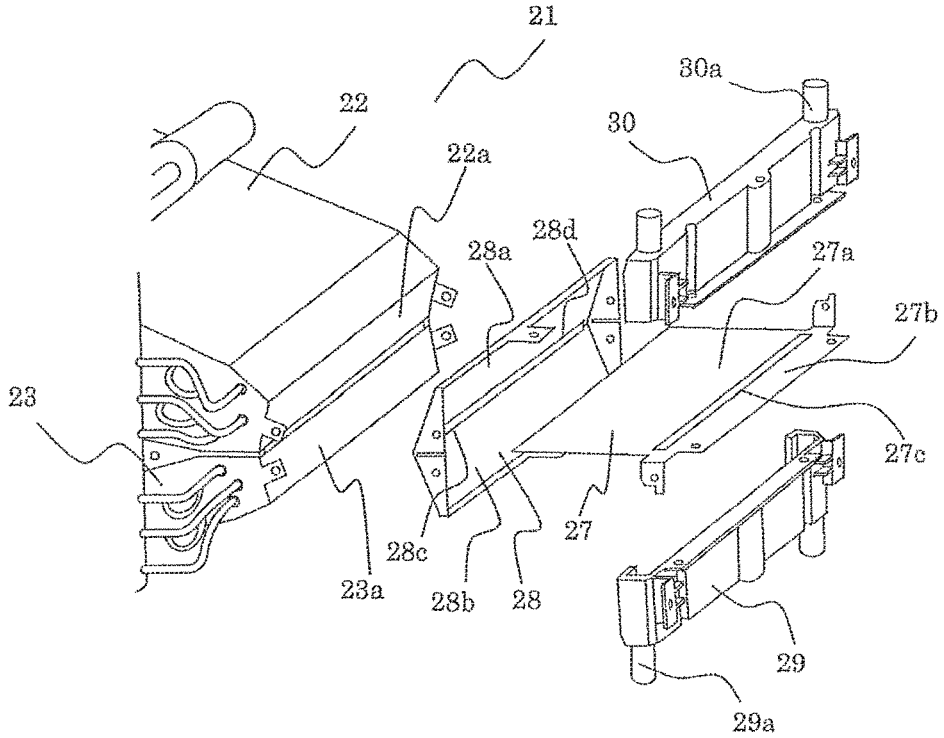
FIG. 11 is an exploded perspective view of a portion of the heat-exchange unit of the air-conditioning apparatus according to Embodiment 1 of the present invention.
Figure 12:
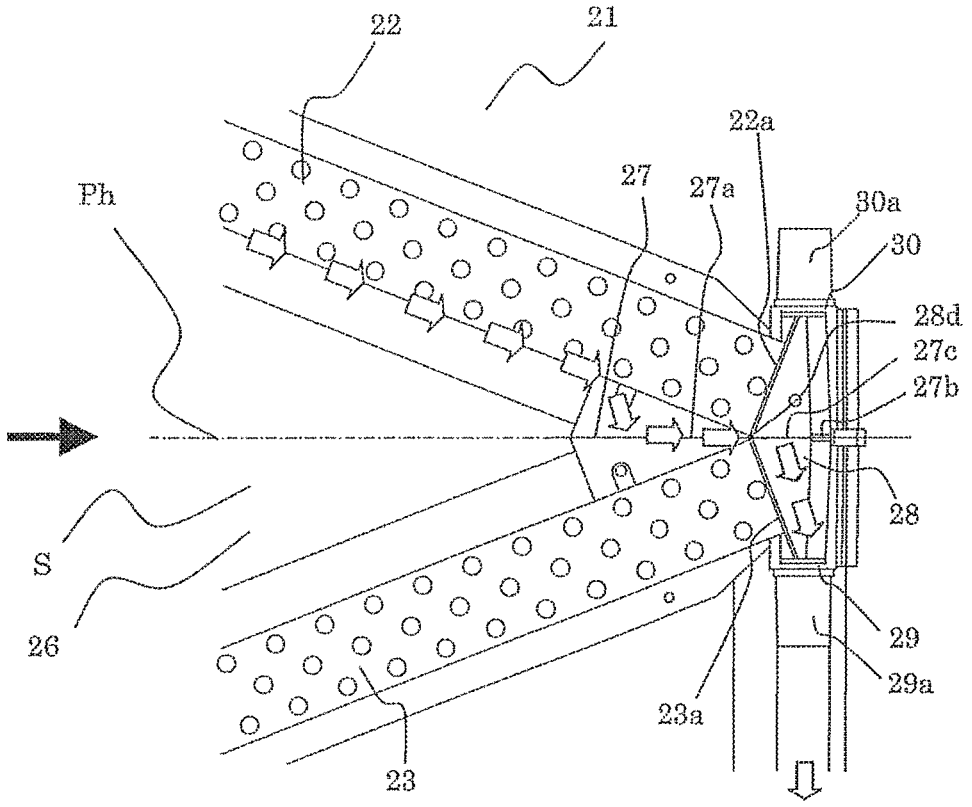
FIG. 12 is a sectional view of a portion of the heat-exchange unit of the air-conditioning apparatus according to Embodiment 1 of the present invention.

FIG. 9 is a perspective view of the heat-exchange unit of the air-conditioning apparatus according to Embodiment 1 of the present invention. FIG. 10 is a sectional view of the heat-exchange unit of the air-conditioning apparatus according to Embodiment 1 of the present invention. FIG. 11 is an exploded perspective view of a portion of the heat-exchange unit of the air-conditioning apparatus according to Embodiment 1 of the present invention. FIG. 12 is a sectional view of a portion of the heat-exchange unit of the air-conditioning apparatus according to Embodiment 1 of the present invention. Note that FIG. 9 shows the heat-exchange unit 21 in a state in which the air-conditioning apparatus 1 is used in such a disposition state that the air-blowing direction is oriented upward or downward. Furthermore, FIGS. 10 to 12 shows the heat-exchange unit 21 in a state in which the air-conditioning apparatus 1 is used in such a disposition state that the air-blowing direction is oriented rightward. Furthermore, in FIGS. 10 and 12, air flows are shown by fill-in arrows. Furthermore, in FIG. 12, the direction of a condensate-water flow is shown by empty arrows.

As shown in FIGS. 9 to 12, the space S is formed between the pair of heat exchangers 22 and 23 provided adjacent to each other in a V-shape, and each of both sides of the space S is blocked by a pair of air-passage plates 26. Hence, in a state in which the air-conditioning apparatus 1 is used in such a disposition state that the air-blowing direction is oriented rightward or leftward, air flows directed from the inside of the space S to the outside of the space S through the pair of heat exchangers 22 and 23 are generated.

The heat-exchange unit 21 has a partition plate 27 disposed in such a state that a first region 27*a* located inside the space S and a second region 27*b* located outside the space S are formed. The partition plate 27 is disposed in such a state that a boundary between the first region (27*a*) and the second region (27*b*) is positioned at a portion between the end 22*a* of the heat exchanger 22 closer to the heat exchanger 23 and the end 23*a* of the heat exchanger 23 closer to the heat exchanger 22. Hence, in a state in which the air-conditioning apparatus 1 is used in such a disposition state that the air-blowing direction is oriented rightward or leftward, the second region 27*b* is located on the downstream side of the first region 27*a*. Furthermore, the partition plate 27 is disposed in such a state that the relative angle between the partition plate 27 and the heat exchanger 22 and the relative angle between the partition plate 27 and the heat exchanger 23 are equal. In other words, in a state in which the air-conditioning apparatus 1 is used in such a disposition state that the air-blowing direction is oriented rightward or leftward, the partition plate 27 is horizontal.

The partition plate 27 is inserted into a first through-hole 28*d* of a closing plate 28, with a gap therebetween, the closing plate 28 having an end-closing portion 28*a* for closing the end 22*a*, an end-closing portion 28*b* for closing the end 23*a*, and a connecting portion 28*c* that connects end-closing portion 28*a* and the end-closing portion 28*b* and has the first through-hole 28*d*. By closing the end 22*a* of the heat exchanger 22 and the end 23*a* of the heat exchanger 23 with the closing plate 28, passage of air flows through the end 22*a* of the heat exchanger 22 and the end 23*a* of the heat exchanger 23 is suppressed. Furthermore, the closing plate 28 fixes the end 22*a* of the heat exchanger 22 and the end 23*a* of the heat exchanger 23.

A pair of sub drain pans 29 and 30 are each disposed at corresponding one of the front and back sides of the second region 27*b* of the partition plate 27. The partition plate 27 is held between the pair of sub drain pans 29 and 30, whereby the positional relationship between the partition plate 27 and the first through-hole 28*d* is maintained. Furthermore, the pair of sub drain pans 29 and 30 are held by the closing plate 28. In a state in which the air-conditioning apparatus 1 is used in such a disposition state that the air-blowing direction is oriented rightward, the sub drain pan 29 is located below the second through-hole 27*c* provided in the second region 27*b* of the partition plate 27, and, in a state in which the air-conditioning apparatus 1 is used in such a disposition state that the air-blowing direction is oriented leftward, the sub drain pan 30 is located below the second through-hole 27*c* provided in the second region 27*b* of the partition plate 27. In a state in which the air-conditioning apparatus 1 is used in such a disposition state that the air-blowing direction is oriented rightward, the sub drain pan 29 corresponds to a "first drain pan" of the present invention, and the sub drain pan 30 corresponds to a "second drain pan" of the present invention. In a state in which the air-conditioning apparatus 1 is used in such a disposition state that the air-blowing direction is oriented leftward, the sub drain pan 30 corresponds to the "first drain pan" of the present invention, and the sub drain pan 29 corresponds to the "second drain pan" of the present invention.

As shown in FIG. 12, in a state in which the air-conditioning apparatus 1 is used in such a disposition state that the air-blowing direction is oriented rightward, the condensate water generated in the heat exchanger 22 located on the upper side drops on the top surface of the first region 27*a* of the partition plate 27 and is guided by the air flow to the second region 27*b* through the first through-hole 28*d*. The second through-hole 27*c* formed in the second region 27*b* serves as an inlet of a drain path; and the condensate water flowing into the second region 27*b* flows into the sub drain pan 29 through the second through-hole 27*c*. The condensate water flowing into the sub drain pan 29 flows down on the inclined surface, is guided to a sub drain port 29*a* formed in the sub drain pan 29, and flows into the second main drain pan 25 through a drain tube connected to the sub drain port 29*a*. The condensate water flowing into the second main drain pan 25 flows down on the inclined surface, is guided to a main drain port 25*a* provided in the second main drain pan 25, and is discharged to the outside of the main body 11. Furthermore, the condensate water generated in the heat exchanger 23 located on the lower side directly drops on the second main drain pan 25 and is discharged to the outside of the main body 11 through the main drain port 25*a* formed in the second main drain pan 25. In a state in which the air-conditioning apparatus 1 is used in such a disposition state that the air-blowing direction is oriented rightward, the sub drain port 29*a* corresponds to a "drain section" of the present invention. As shown in FIGS. 9 to 12, when more than one sub drain port 29*a* is formed, each of the sub drain ports 29*a* corresponds to the "drain section" of the present invention.

The hole area of the second through-hole 27*c*, that is, the flow-path sectional area of the inlet of a drain path is larger than the hole area of the sub drain port 29*a* (in the case where a plurality of sub drain ports 29*a* are formed, the total hole area), that is, the flow-path sectional area of the drain section formed in the sub drain pan 29. This configuration makes it possible to suppress the occurrence of overflow, clogging, or other problems occurring in the drain path. Furthermore, the hole area of the sub drain port 29*a* (in the case where a plurality of sub drain ports 29*a* are formed, the total hole area), that is, the flow-path sectional area of the drain section formed in the sub drain pan 29 is larger than the hole area of the main drain port 25*a* (in the case where a plurality of main drain ports 25*a* are formed, the total hole area), that is, the flow-path sectional area of the drain section formed in the second main drain pan 25. Furthermore, the hole area of the first through-hole 28*d* formed in the closing plate 28 is smaller than the hole area of the second through-hole 27*c*, that is, the flow-path sectional area of the inlet of a drain path, and is larger than the hole area of the sub drain port 29*a* (in the case where a plurality of sub drain ports 29*a* are formed, the total hole area), that is, the flow-path sectional area of the sub drain section formed in the sub drain pan 29.

Also in a state in which the air-conditioning apparatus 1 is used in such a disposition state that the air-blowing direction is oriented leftward, similarly to the state in which the air-conditioning apparatus 1 is used in such a disposition state that the air-blowing direction is oriented rightward, the condensate water generated in the heat exchanger 23 located on the upper side drops on the top surface of the first region 27*a* of the partition plate 27 and is guided to the second region 27*b* through the first through-hole 28*d* by the air flow. The condensate water flowing in the second region 27*b* flows into the sub drain pan 30 through the second through-hole 27*c*. The condensate water flowing into the sub drain pan 30 flows down on the inclined surface, is guided to the sub drain port 30*a* formed in the sub drain pan 30, and flows into the second main drain pan 25 through the drain tube connected to the sub drain port 30*a*. The condensate water flowing into the second main drain pan 25 flows down on the inclined surface, is guided to the main drain port 25*a* formed in the second main drain pan 25, and is discharged to the outside of the main body 11. Furthermore, the condensate water generated in the heat exchanger 22 located on the lower side directly drops on the second main drain pan 25 and is discharged to the outside of the main body 11 through the main drain port 25*a* formed in the second main drain pan 25. In a state in which the air-conditioning apparatus 1 is used in such a disposition state that the air-blowing direction is oriented leftward, the sub drain port 30*a* corresponds to the "drain section" of the present invention. As shown in FIGS. 9 to 12, in the case where a plurality of sub drain ports 30*a* are formed, each of the sub drain ports 30*a* corresponds to a part of the "drain section" of the present invention.

The hole area of the second through-hole 27*c*, that is, the flow-path sectional area of the inlet of a drain path is larger than the hole area of the sub drain port 30*a* (in the case where a plurality of sub drain ports 30*a* are formed, the total hole area), that is, the flow-path sectional area of the drain section formed in the sub drain pan 30. This configuration makes it possible to suppress the occurrence of overflow, clogging, or other problems in the drain path. Furthermore, the hole area of the sub drain port 30*a* (in the case where a plurality of sub drain ports 30*a* are formed, the total hole area), that is, the flow-path sectional area of the drain section formed in the sub drain pan 30 is larger than the hole area of the main drain port 25*a* (in the case where a plurality of main drain ports 25*a* are formed, the total hole area), that is, the flow-path sectional area of the drain section formed in the second main drain pan 25. Furthermore, the hole area of the first through-hole 28*d* formed in the closing plate 28 is larger than the hole area of the sub drain port 30*a* (in the case where a plurality of sub drain ports 30*a* are formed, the total hole area), that is, the flow-path sectional area of the drain section formed in the sub drain pan 30.

The length of the partition plate 27 in the air-flow passing direction is, for example, about 70 mm. It is desirable that the length of the partition plate 27 be set to such a length that the partition plate 27 can sufficiently suppress dropping of the condensate water generated in the heat exchanger 22 or the heat exchanger 23 located on the upper side on the heat exchanger 23 or the heat exchanger 22 located on the lower side.

The invention claimed is:

1. An air-conditioning apparatus comprising:

a main body having an air passage formed therein; and a heat-exchange unit disposed in the air passage, the heat-exchange unit including a first heat exchanger and a second heat exchanger provided adjacent to each other, and a partition plate disposed in such a state that a first region of the partition plate is located inside a space between the first heat exchanger and the second heat exchanger and a second region of the partition plate is located outside the space between the first heat exchanger and the second heat exchanger, a first drain pan and a second drain pan that configured to hold the partition plate in place by attaching respectively to a front face and a back face opposite to the front face of the partition plate, in a first disposition state, the main body being disposed in such an orientation that an air flow generated in the air passage passes through the heat-exchange unit in a direction intersecting the direction of gravity, in the first disposition state, the heat-exchange unit being disposed in such an orientation that the first heat exchanger is provided adjacent to, and above, the second heat exchanger and that the second region of the partition plate is located on a downstream side of the first region of the partition plate in a direction of the air flow generated in the air passage, the second region of the partition plate being provided with an opening extending through the front face and the back face of the partition plate configured as an inlet of a drain path communicating with the outside of the main body, and in the first disposition state, the heat-exchange unit is disposed in such an orientation that the first drain pan is located below the inlet to form a part of the drain path.

2. The air-conditioning apparatus of claim 1, wherein the first heat exchanger and the second heat exchanger are provided adjacent to each other in a V-shape, and the partition plate is disposed in such a state that a boundary between the first region and the second region is positioned at a portion between a first end of the first heat exchanger, which is closer to the second heat exchanger, and a second end of the second heat exchanger, which is closer to the first heat exchanger.

3. The air-conditioning apparatus of claim 2, wherein, in the first disposition state, the main body is disposed in such an orientation that an air flow generated in the air passage passes horizontally through the heat-exchange unit, in the first disposition state, the heat-exchange unit is disposed in such an orientation that the first heat exchanger and the second heat exchanger are provided adjacent to each other, symmetrically with respect to a horizontal plane, and the partition plate is disposed in such a state that a relative angle between the partition plate and the first heat exchanger and a relative angle between the partition plate and the second heat exchanger are equal.

4. The air-conditioning apparatus of claim 2, wherein the heat-exchange unit has a closing plate including a pair of end-closing portions that close each of the first end and the second end.

5. The air-conditioning apparatus of claim 4, wherein the closing plate includes a connecting portion configured to connect the pair of end-closing portions, the connecting portion being provided with a first through-hole, and the partition plate is inserted into the first through-hole with a gap therebetween.

6. The air-conditioning apparatus of claim 1, wherein the first drain pan is provided with a drain section, and a flow-path sectional area at the inlet is larger than a flow-path sectional area of the drain section.

7. The air-conditioning apparatus of claim 1, wherein the inlet is a second through-hole provided in the second region of the partition plate.

8. The air-conditioning apparatus of claim 1, wherein the first heat exchanger and the second heat exchanger are provided adjacent to each other in a V-shape, and the partition plate is disposed between the first heat exchanger and the second heat exchanger at the apex end of the V-shape.

* * * * *